US011768044B2

(12) United States Patent
Underwood et al.

(10) Patent No.: US 11,768,044 B2
(45) **Date of Patent: *Sep. 26, 2023**

(54) CHARGING HANDLE ASSEMBLIES

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/889,536

(22) Filed: Aug. 17, 2022

(65) Prior Publication Data

US 2022/0390199 A1 Dec. 8, 2022

Related U.S. Application Data

(63) Continuation of application No. 17/341,581, filed on Jun. 8, 2021, now Pat. No. 11,466,945.

(60) Provisional application No. 63/036,436, filed on Jun. 8, 2020.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72
USPC ..... 89/1.4
See application file for complete search history.

(56) References Cited

U.S. PATENT DOCUMENTS

| | | | | |
|---|---|---|---|---|
| 7,798,045 | B1 | 9/2010 | Fitzpatrick et al. | |
| 7,832,322 | B1 | 11/2010 | Hoel | |
| 8,863,632 | B1 | 10/2014 | O'Malley | |
| 8,960,066 | B2 | 2/2015 | Gomez | |
| 9,175,913 | B2 | 11/2015 | Cupps et al. | |
| 9,733,030 | B2 | 8/2017 | Daniel et al. | |
| 9,746,263 | B2 | 8/2017 | Hillman | |
| 9,846,003 | B2 | 12/2017 | Hwang | |
| 10,001,328 | B1 | 6/2018 | Parker et al. | |
| 11,466,945 | B2 * | 10/2022 | Underwood | F41A 3/72 |
| 2016/0356564 | A1 | 12/2016 | Curry | |
| 2020/0292258 | A1 * | 9/2020 | Hubbell | F41A 3/72 |
| 2021/0222972 | A1 | 7/2021 | Bray et al. | |

* cited by examiner

*Primary Examiner* — Reginald S Tillman, Jr.

(57) ABSTRACT

A charging handle assembly for a firearm includes a main body with a head and a shaft extending forward from the head, a left handle disposed at the head, a right handle disposed at the head, at least one latch disposed at the head, and a plunger disposed at the head. The left handle and the right handle are identical.

22 Claims, 17 Drawing Sheets

CHARGING HANDLE ASSEMBLIES

CROSS REFERENCE TO RELATED APPLICATIONS

This application is a continuation of U.S. patent application Ser. No. 17/341,581 ("the '581 application") filed Jun. 8, 2021, which is related to and claims priority benefit from U.S. Provisional Application No. 63/036,436 ("the '436 application"), filed on Jun. 8, 2020 and entitled "CHARGING HANDLE ASSEMBLIES." The '581 application and the '436 application are each hereby incorporated in their entirety by this reference.

FIELD OF THE INVENTION

The field of the invention relates to firearms, particularly improved charging handle assemblies in firearms.

BACKGROUND

Many breech-loading firearms are designed with a moving bolt or bolt carrier group to facilitate loading cartridges into the chamber of the firearm. The bolt or bolt carrier group blocks the rear opening (breech) of the barrel chamber in preparation for firing the weapon. Whether the operating system of the firearm is designed to cycle manually (bolt-action, lever-action, pump-action, etc.), semi-automatic (gas operation, recoil operation, blowback operation), or automatic, the firearm must include a mechanism for moving the bolt or bolt carrier group manually to facilitate ejection of a cartridge/shell, to load a new cartridge, and/or to move the fire control group to the ready to fire configuration. Conventional firearms include charging handle assemblies with a mechanism on one side only (i.e., not ambidextrous) and that are unreliable and uncomfortable for the operator. In addition, many conventional firearms include charging handle assemblies where the latch for engaging the receiver of the firearm is integral or directly connected to the handle mechanism, which results in mechanisms that are different to close or reengage (i.e., push forward).

To increase reliability and efficiency while improving ergonomics of firearms, it may be desirable to design new charging handle assemblies and related systems.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a charging handle assembly for a firearm comprises: a main body comprising a head and a shaft extending forward from the head; a left handle disposed at the head; a right handle disposed at the head; at least one latch disposed at the head; and a plunger disposed at the head, wherein the left handle and the right handle are identical.

According to certain embodiments of the present invention, a charging handle assembly for a firearm comprises: a main body comprising a head and a shaft extending forward from the head; a left handle disposed at the head; a right handle disposed at the head; at least one latch disposed at the head; and a plunger disposed at the head, wherein the at least one latch is a separate component from both the left handle and the right handle.

According to certain embodiments of the present invention, a charging handle assembly for a firearm comprises: a main body comprising a head and a shaft extending forward from the head; a left handle disposed at the head; a right handle disposed at the head; a left latch disposed at the head adjacent to the left handle; a secondary latch disposed at the head adjacent to the right handle; and a plunger disposed at the head, wherein: the left latch is a separate component from the left handle; the secondary latch is a separate component from the right handle; and the left handle and the right handle are identical.

DETAILED DESCRIPTION

Figure 1:
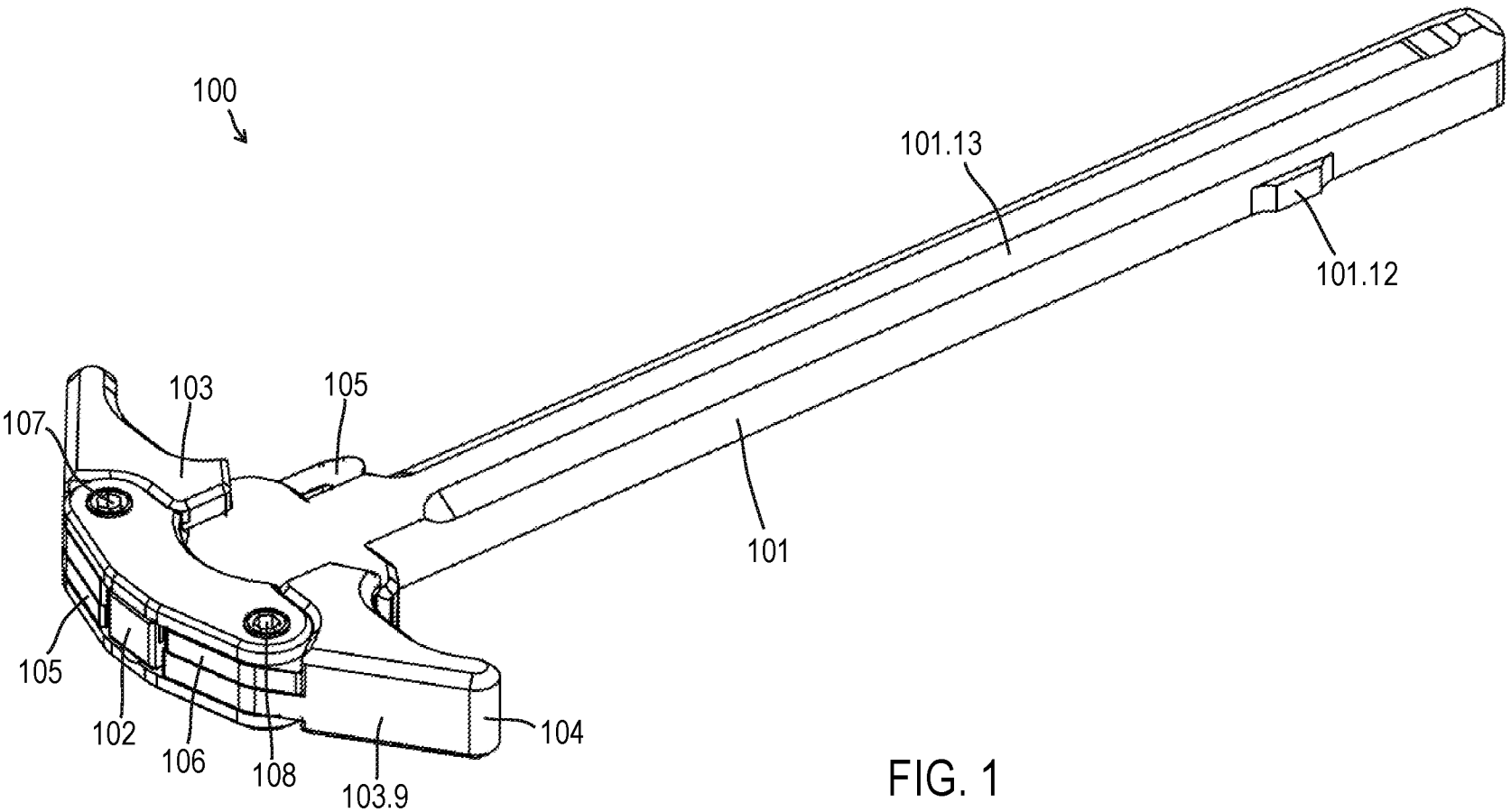
FIG. 1 is a rear perspective view of a charging handle assembly according to certain embodiments of the present invention.
Figure 2:
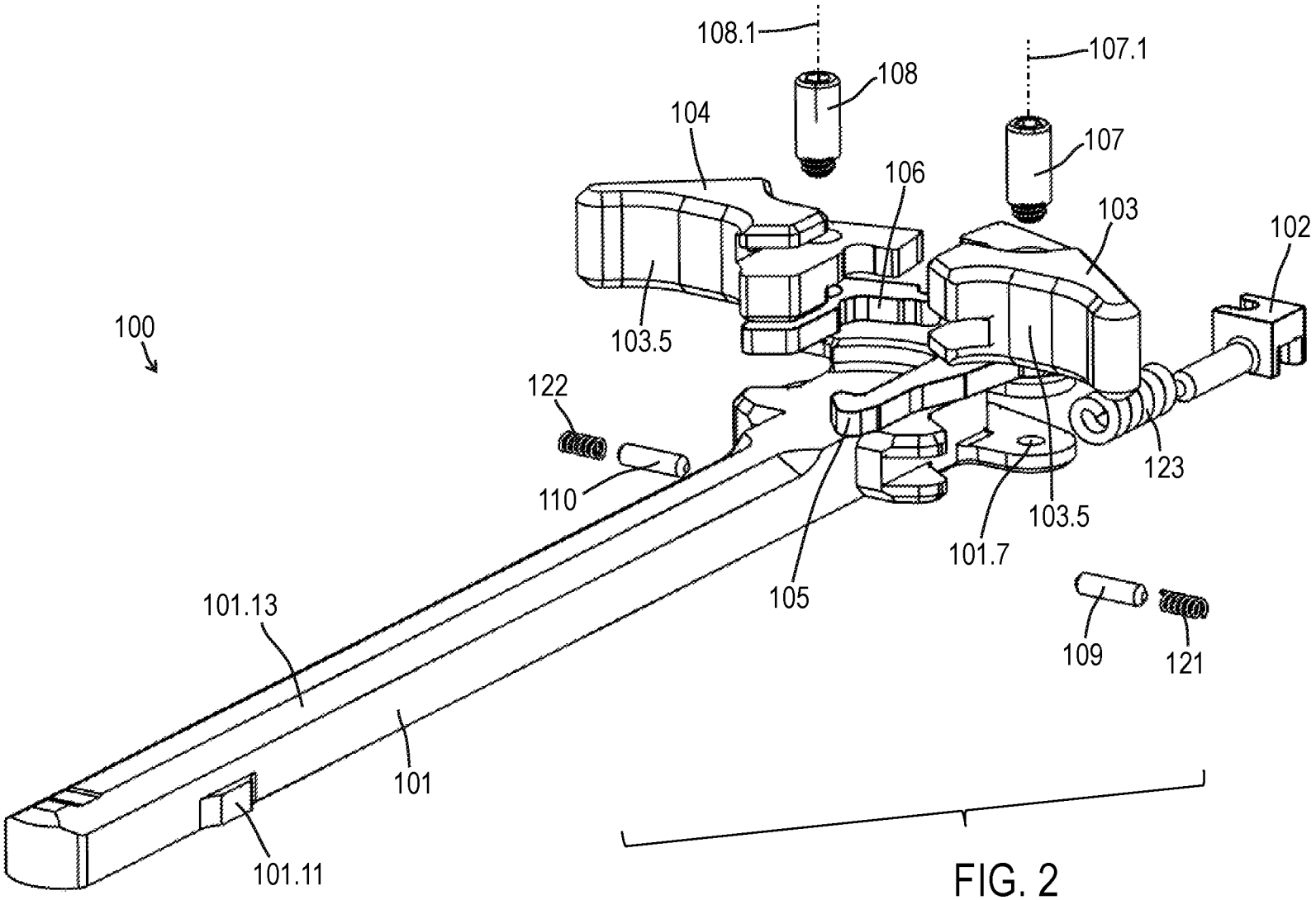
FIG. 2 is a front perspective exploded view of the charging handle assembly of FIG. 1.
Figure 3:
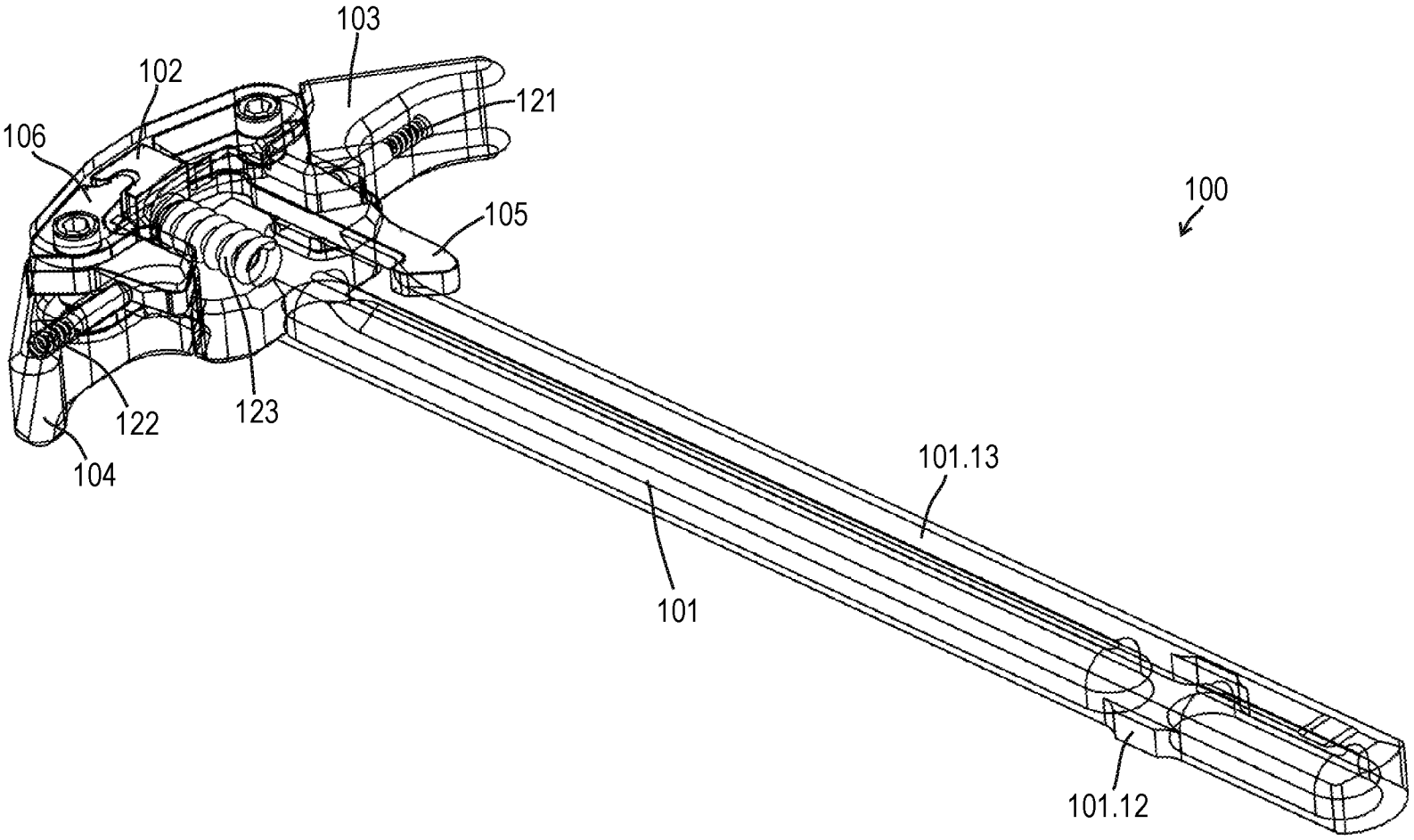
FIG. 3 is a front perspective view of the charging handle assembly of FIG. 1 with some components transparent.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-14C show components of the AR-15 variant (civilian) or M16/M4 (military) firearm platform (i.e., AR-15 style firearms), the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, .410 gauge, 10 gauge, 16 gauge.

In some embodiments, including illustrative examples shown in FIGS. 1-8B, a charging handle assembly 100 includes a main body 101; at least one handle 103, 104; at least one latch 105, 106; and a plunger 102. The handle(s) 103, 104; latches 105, 106; and plunger 102 may be attached to a head 101.1 of the main body 101 where the head 101.1 is located at or near the rear end of the main body 101. As shown in FIGS. 5A-7B, on each side of the charging handle assembly 100, the handle may be a separate component from the latch. The arrangement of a separate latch from the handle allows the operator to press forward on rear surface 103.9 of the handles 103, 104 when reengaging the charging handle assembly 100. In contrast, conventional charging handles when pushed on the analogous surface will prevent the latch from operating. In some embodiments, on the left side of the head 101.1, the main body 101 includes a hole 101.7 that extends through a full height of the main body 101 (see FIGS. 2, 4A-4B). The hole 101.7 may be configured to interface with a fastener 107. In some cases, the fastener 107 is a roll pin for rotational interfacing with other components of the charging handle assembly 100. In other embodiments, the hole 101.7 may include a lower portion 101.7.1 with a smaller diameter that is threaded to interface with the fastener 107 (see FIGS. 4A and 4B). In some embodiments, the fastener 107 includes a large diameter portion with a smooth surface for interfacing with the left handle 103, the left latch 105, and the upper portion of the head 101.1. The fastener 107 may also include a smaller diameter threaded portion for interfacing with the lower portion 101.7.1. Similarly, the right side of the head 101.1 of the main body 101 may include a hole 101.8 that extends through a full height of the main body 101 (see FIGS. 4A-4B). The hole 101.8 may be configured to interface with a fastener 108. In some cases, the fastener 108 is a roll pin for rotational interfacing with other components of the charging handle assembly 100. In other embodiments, the hole 101.8 may include a lower portion 101.8.1 with a smaller diameter that is threaded to interface with the fastener 108 (see FIGS. 4A and 4B). In some embodiments, the fastener 108 includes a large diameter portion with a smooth surface for interfacing with the right handle 104, the secondary latch 106, and the upper portion of the head 101.1. The fastener 108 may also include a smaller diameter threaded portion for interfacing with the lower portion 101.8.1.

The charging handle assembly 100 may be configured such that the left hole 101.7 of the main body 101 is aligned and/or coaxial with a corresponding hole of one or more other components. For example, in some embodiments, hole 101.7 of the main body 101 is aligned with hole 103.1 of left handle 103, center axis 107.1 of fastener 107, and hole 105.1 of left latch 105. The right hole 101.8 of the main body 101 may be aligned and/or coaxial with a corresponding hole of one or more other components. For example, in some embodiments, hole 101.8 of the main body 101 is aligned with hole 103.1 of right handle 104, center axis 108.1 of fastener 108, and hole 106.1 of secondary latch 106. Some of these interfaces are visible in FIG. 3 where the main body 101, the left handle 103, and the right handle 104 are transparent.

In some embodiments, the left handle 103 and the left latch 105 may be permanently attached to one another and/or integrally formed as a single component without restricting relative movement between these two parts. Similarly, the right handle 104 and the secondary latch 106 may be permanently attached to one another and/or integrally formed as a single component without restricting relative movement between these two parts.

Figure 4A:
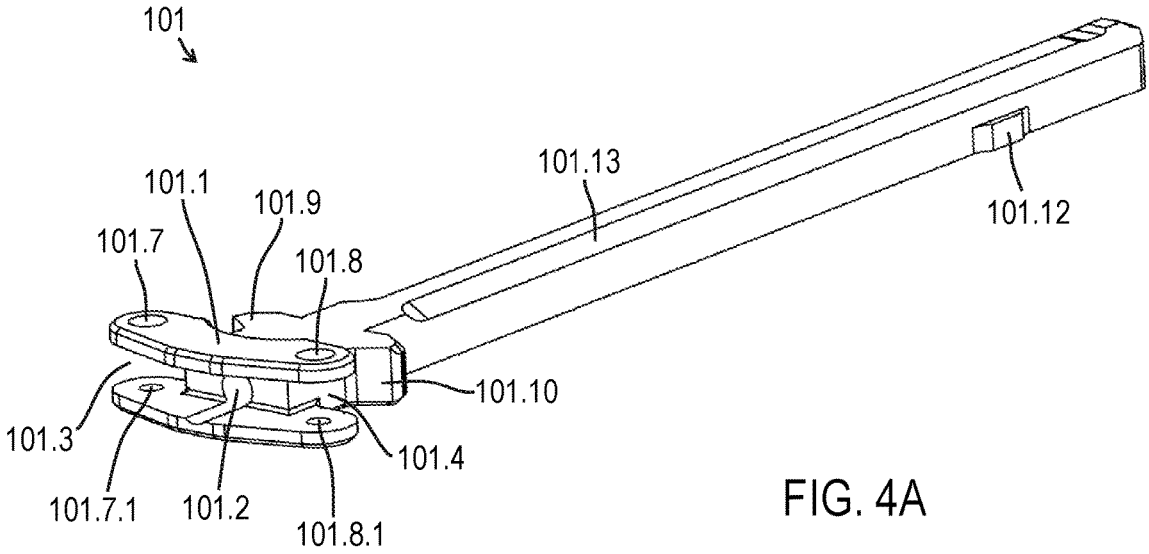
FIG. 4A is a rear perspective view of a main body of the charging handle assembly of FIG. 1.
Figure 4B:
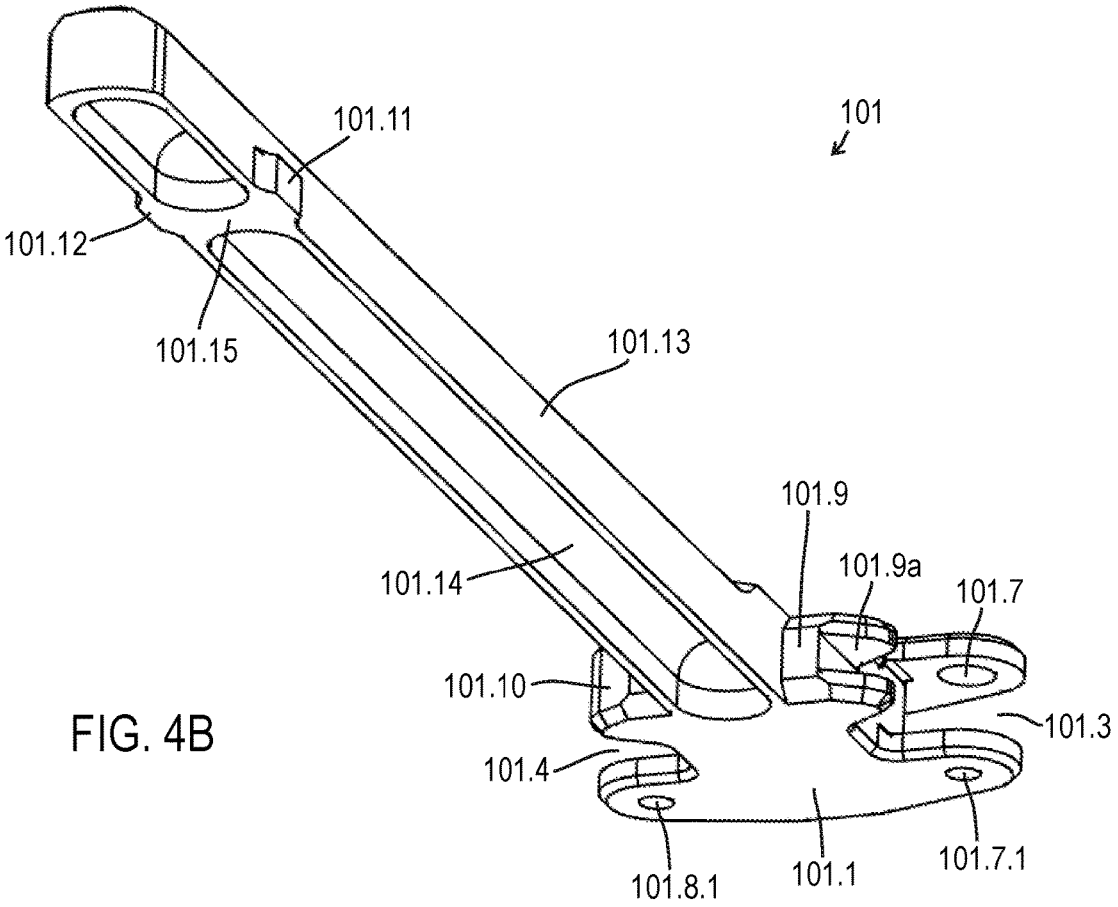
FIG. 4B is a front perspective view of the main body of FIG. 4A.

As shown in FIGS. 4A-4B, the main body 101 may include a head 101.1 at a rear portion and a shaft 101.13 that extends forward from the head 101.1. On the left side of the head 101.1, there is a left opening 101.3 for interfacing with left handle 103 and left latch 105. Similarly, on the right side of the head 101.1, there is a right opening 101.4 for interfacing with right handle 104 and secondary latch 106. The shaft 101.13 may include at least one forward lateral protrusion 101.11, 101.12 that engage a corresponding feature (i.e., a slot) in an upper receiver of a firearm. The shaft 101.13 may also include a channel 101.14 and an internal member 101.15 for engaging and moving a bolt or bolt carrier group of a firearm where the internal member 101.15 is approximately aligned with the at least one forward lateral protrusion 101.11, 101.12. In some embodiments, the shaft 101.13 includes at least one rear lateral protrusion 101.9, 101.10 that forms a continuous shape and/or interfaces with the handle(s) 103, 104 and the latch(es) 105, 106. To interface with the plunger 102, the main body 101 may include a cavity 101.2 such that the shaft 102.1 of the plunger 102 can extend toward the front of the charging handle assembly 100.

Figure 4C:
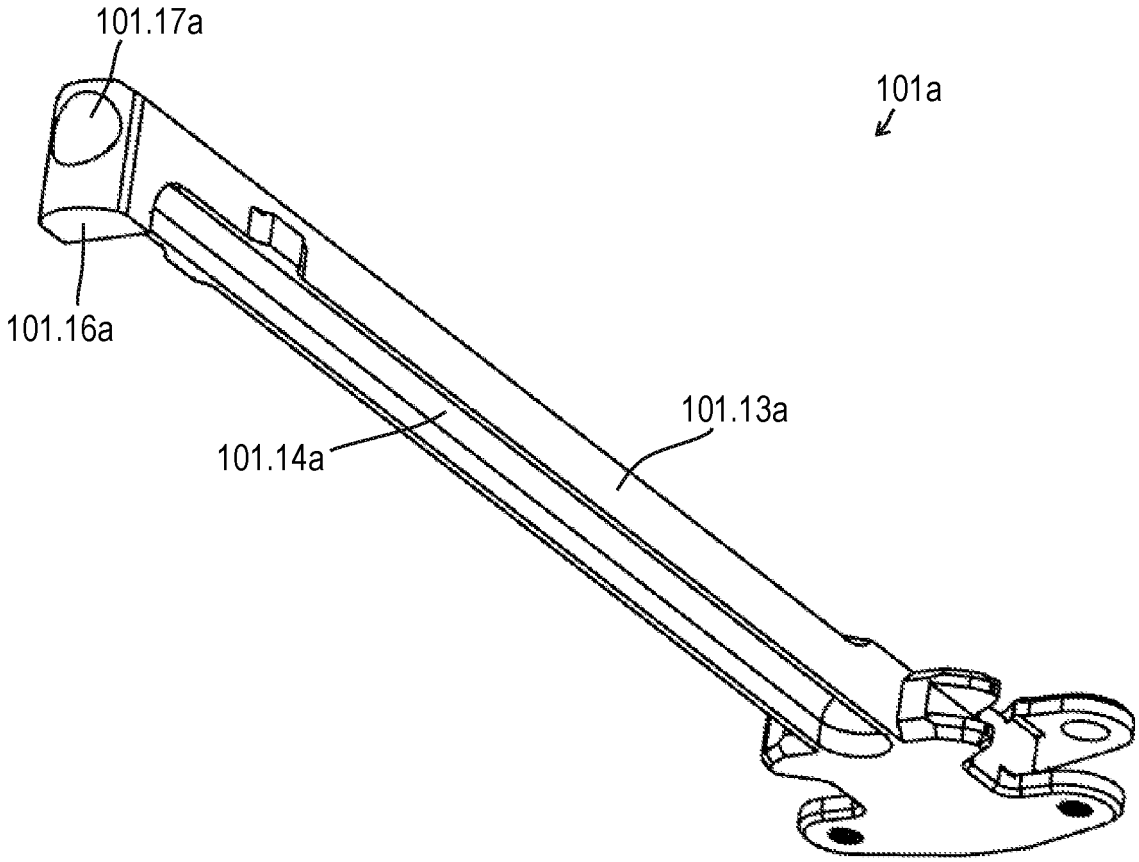
FIG. 4C is a front perspective view of a main body of the charging handle assembly of FIG. 1.

In some embodiments, as shown in FIG. 4C, an alternative main body 101*a* may include at least one of a continuous channel 101.14*a* (with no internal member 101.15), a forward hole 101.17*a* extending through a forward face of the main body 101*a*, and/or a forward protrusion 101.16*a* that extends downward from the shaft 101.13*a*.

Figure 5A:
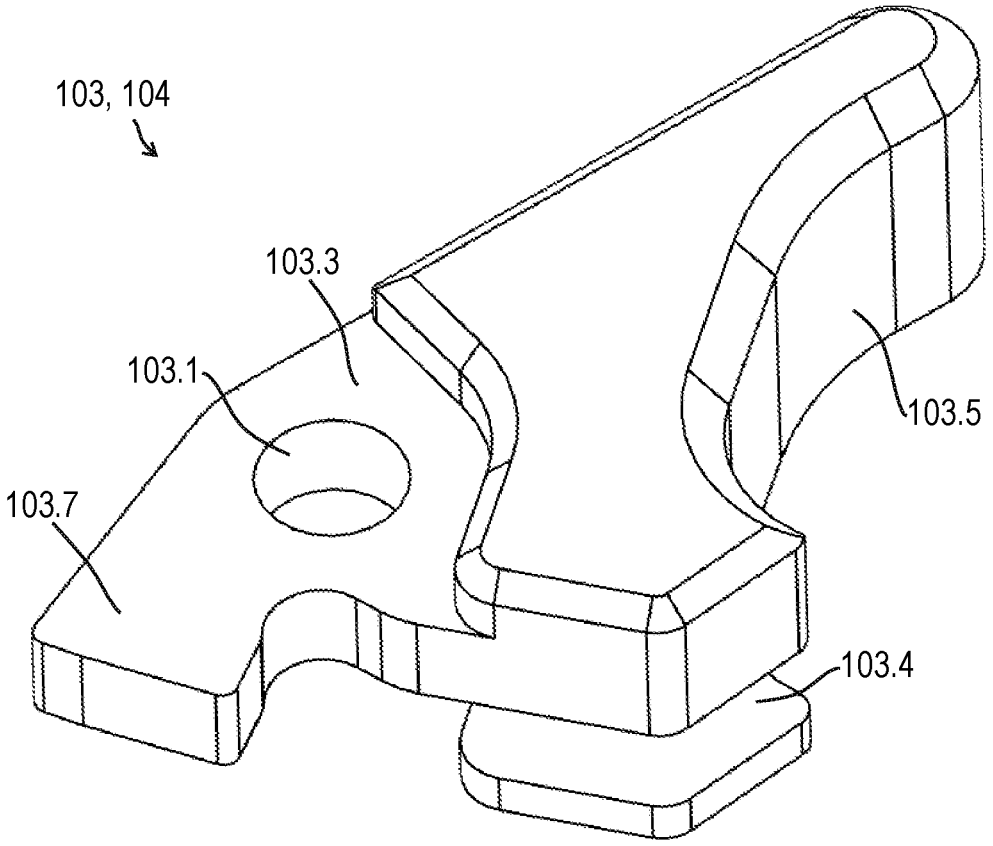
FIG. 5A is a front perspective view of a handle of the charging handle assembly of FIG. 1.
Figure 5B:
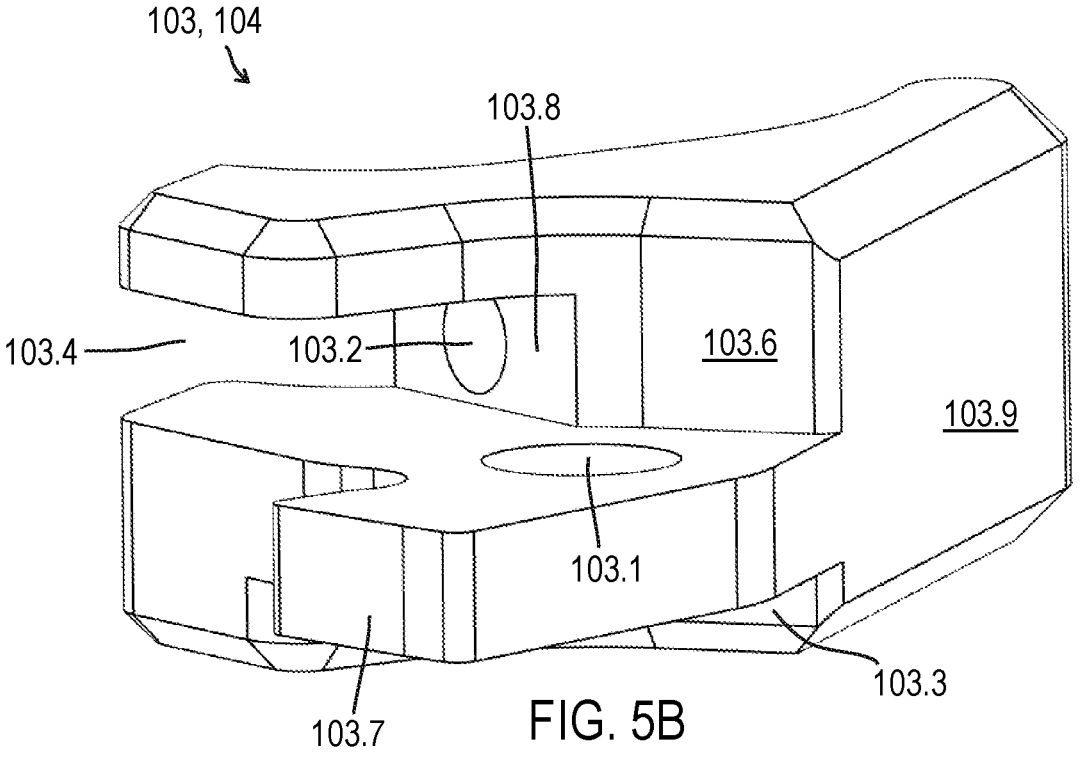
FIG. 5B is a rear perspective view of the handle of FIG. 5A.

The handles 103, 104 may include a tongue 103.7 extending toward a center of the charging handle assembly 100 with a shallow recess 103.3 on one side and a deep recess 103.4 on the opposite side of the tongue 103.7 (see FIGS. 5A-5B). Within the deep recess 103.4, the handles 103, 104 may include a contact surface 103.6 that interfaces with a bearing surface 105.4, 106.4 of the left latch 105 and/or the secondary latch 106. The handles 103, 104 may also include a surface 103.8 with a hole 103.2 that interfaces with a detent pin 109, 110 and/or a spring 121, 122. Moreover, each handle 103, 104 may include an interface surface 103.5. In some embodiments, to simplify manufacturing and production, the left handle 103 and the right handle 104 are identical but inverted when moved from the left side of the charging handle assembly 100 to the right side.

Figure 6A:
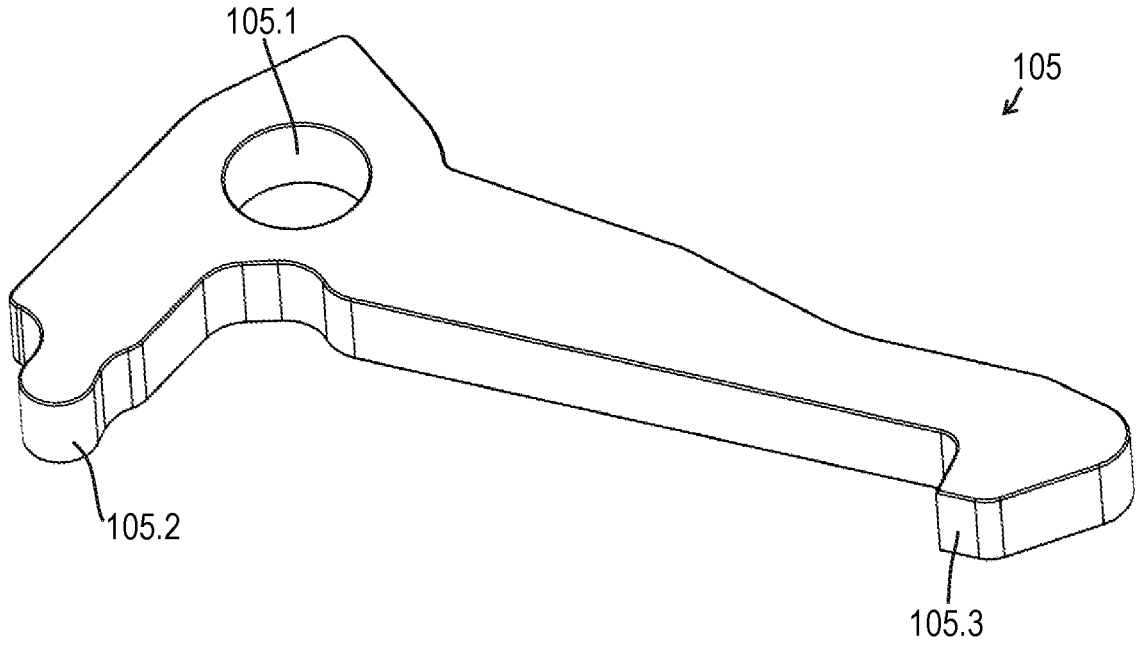
FIG. 6A is a front perspective view of a latch of the charging handle assembly of FIG. 1.
Figure 6B:
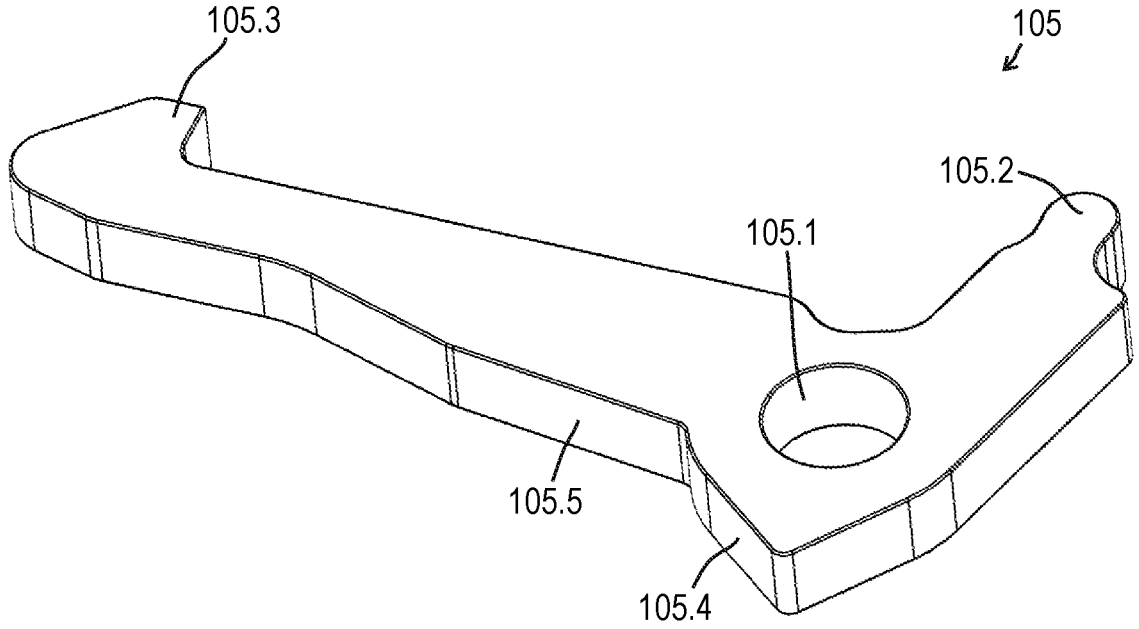
FIG. 6B is a rear perspective view of the latch of FIG. 6A.
Figure 7A:
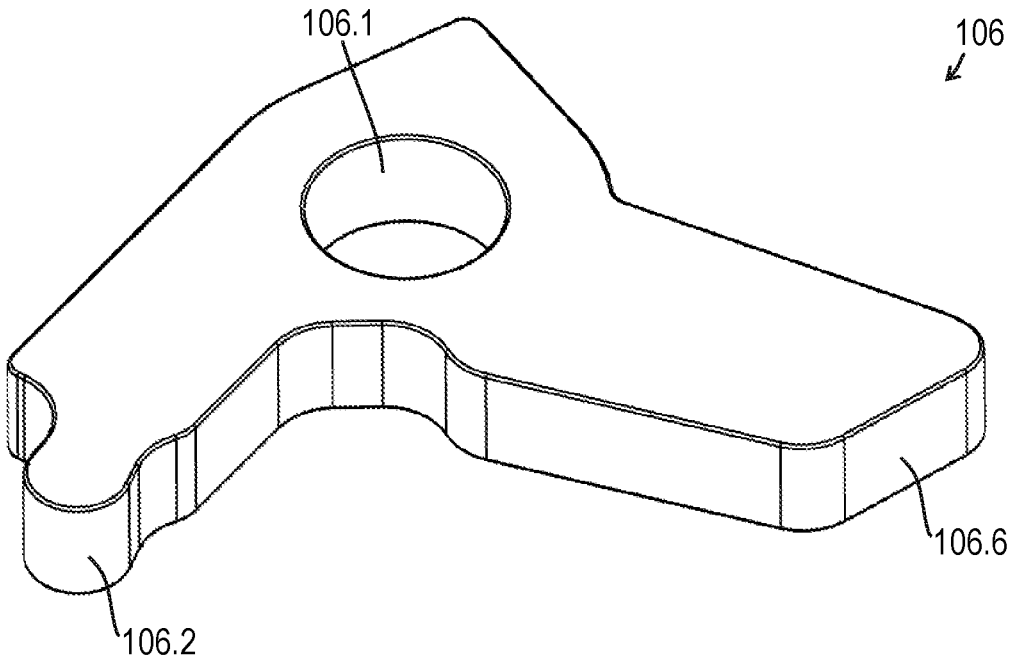
FIG. 7A is a front perspective view of a secondary latch of the charging handle assembly of FIG. 1.
Figure 7B:
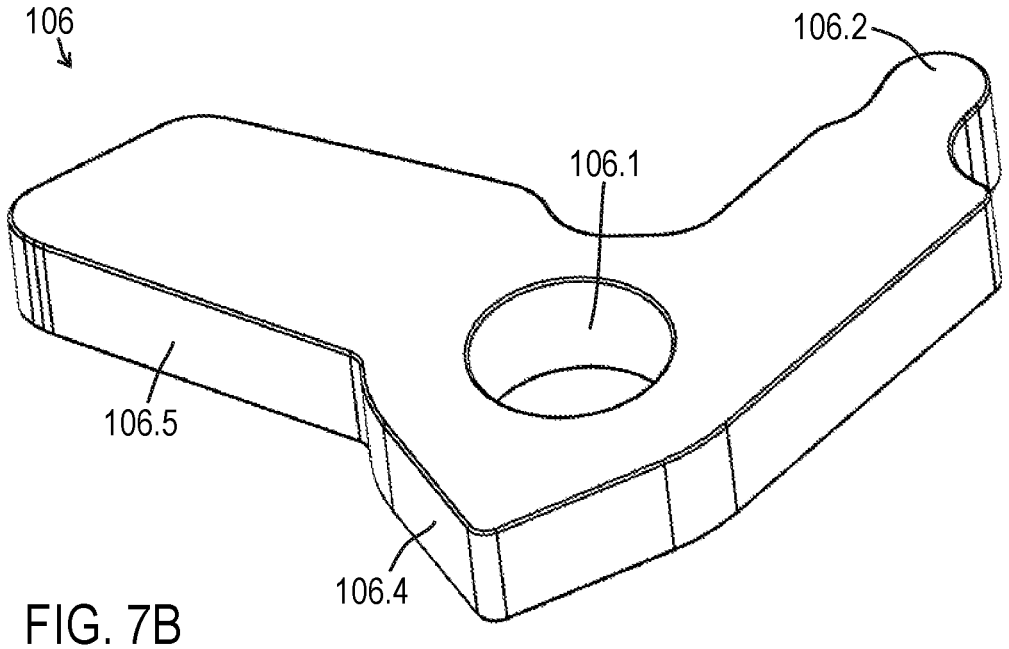
FIG. 7B is a rear perspective view of the secondary latch of FIG. 7A.

As shown in FIGS. 6A-6B, the left latch 105 may include a plunger interface portion 105.2, a receiver interface member 105.3, a bearing surface 105.4, and a detent interface surface 105.5. Similarly, as shown in FIGS. 7A-7B, the secondary latch 106 may include a plunger interface portion 106.2, a bearing surface 106.4, a detent interface surface 106.5, and a cut surface 106.6. In some embodiments, to simplify manufacturing and production, the left latch 105 and the secondary latch 106 are identical except that a portion of the arm that forms the receiver interface member 105.3 is cut at the cut surface 106.6 to form the secondary latch 106. In other words, the secondary latch 106 can be made from the left latch 105 (by removing a portion).

Figure 8A:
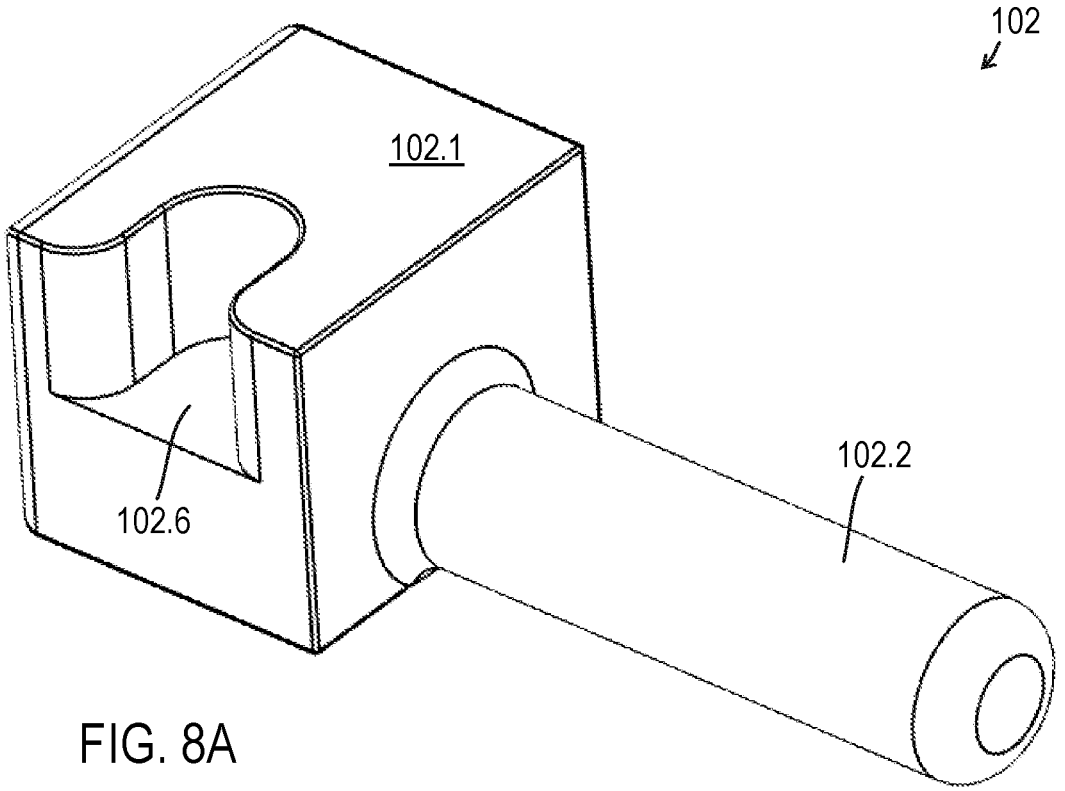
FIG. 8A is a front perspective view of a plunger of the charging handle assembly of FIG. 1.
Figure 8B:
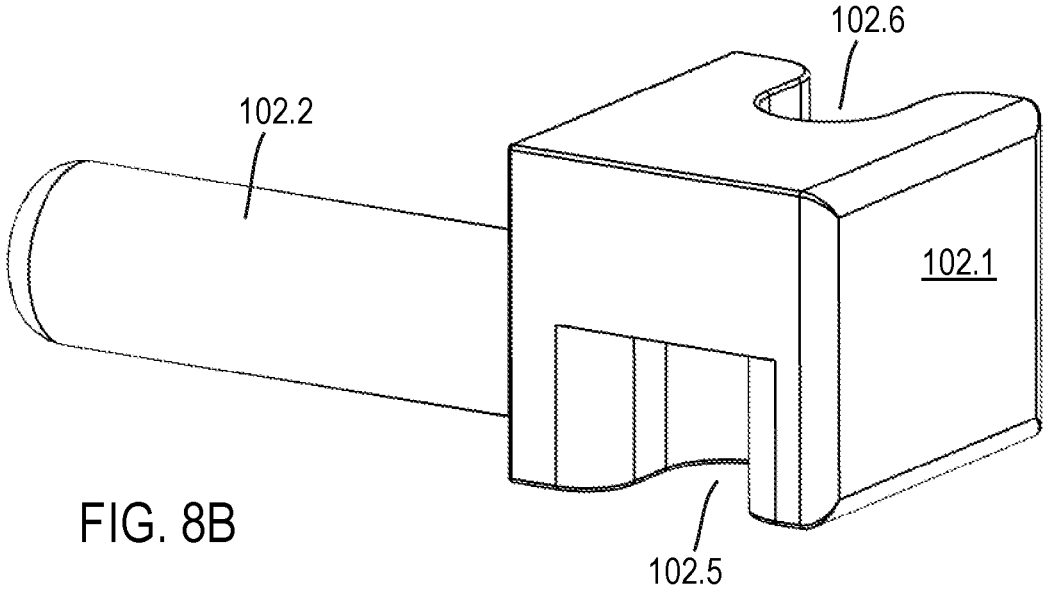
FIG. 8B is a rear perspective view of the plunger of FIG. 8A.
Figure 9:
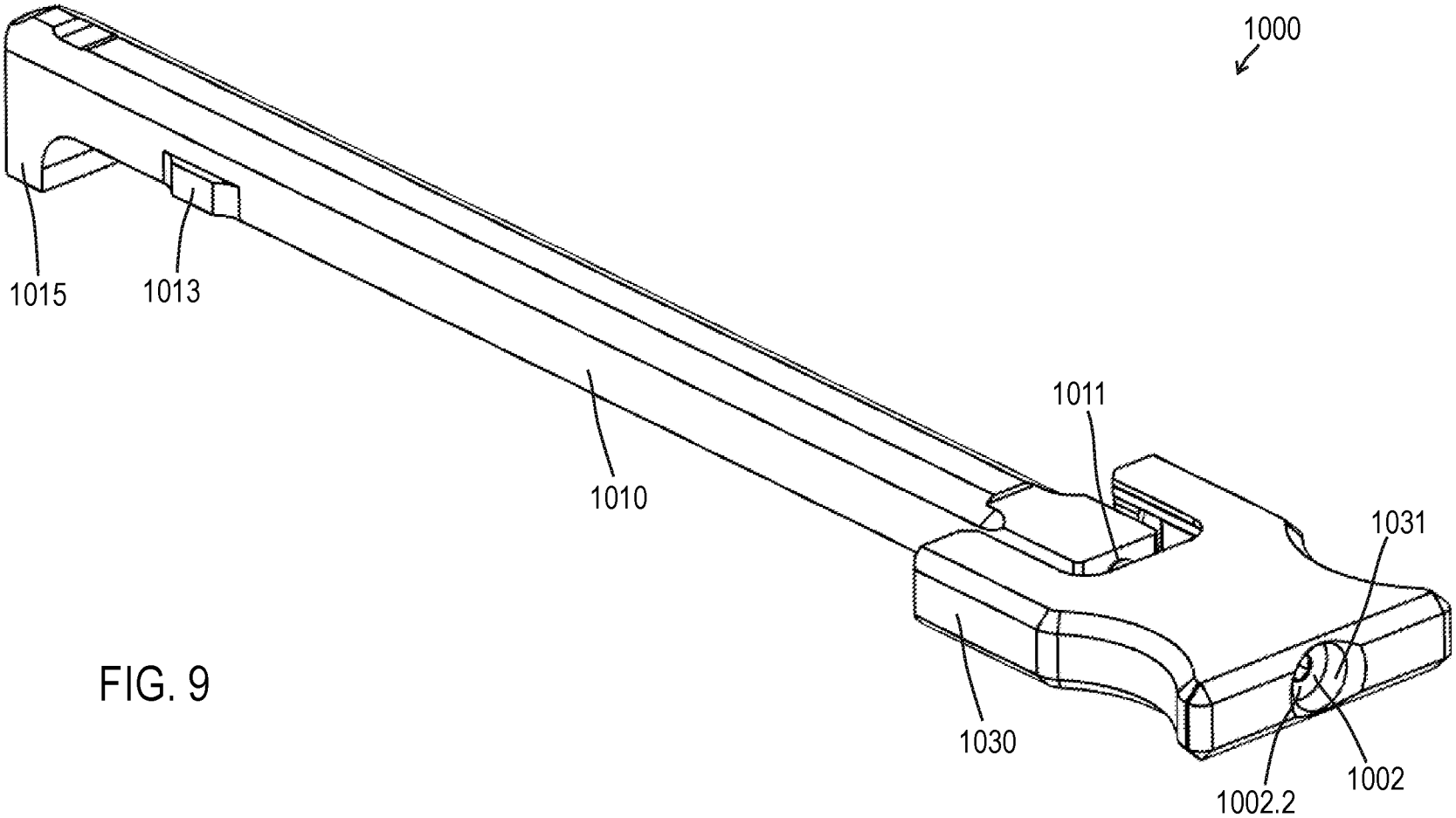
FIG. 9 is a rear perspective view of a charging handle assembly according to certain embodiments of the present invention.
Figure 10:
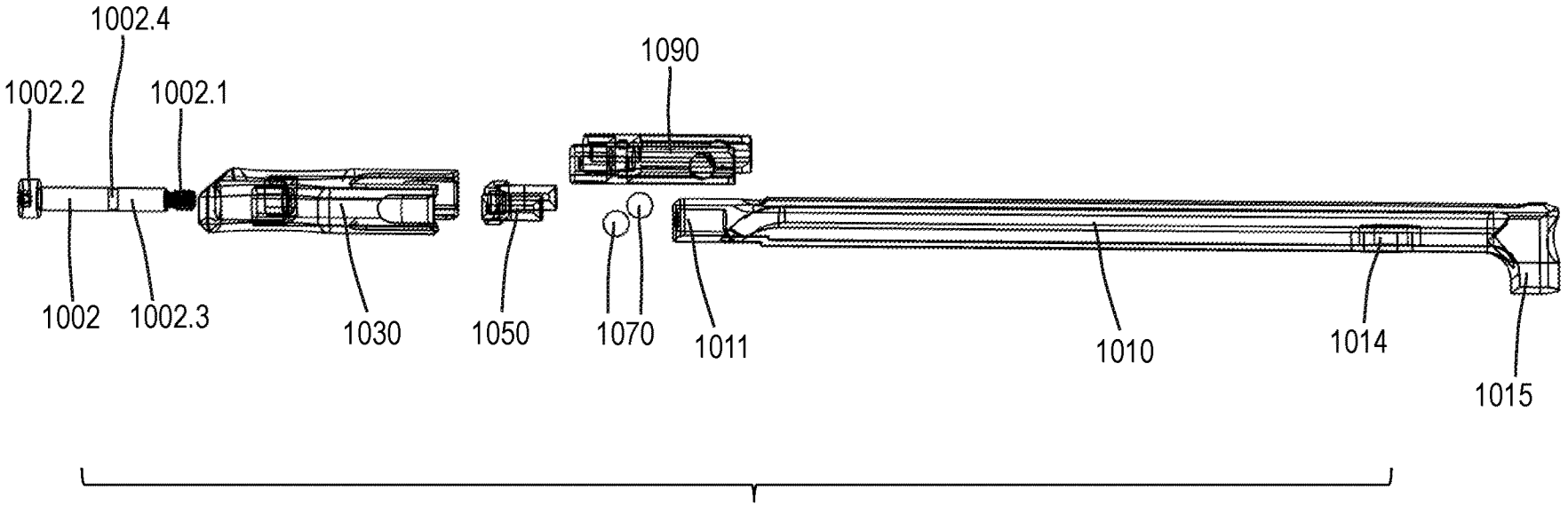
FIG. 10 is a side exploded view of the charging handle assembly of FIG. 9.

The plunger 102 may include a main body 102.1, a protrusion 102.2 extending forward from the main body 102.1, a left latch interface portion 102.5, and a right latch interface portion 102.6 (see FIGS. 8A-8B). The protrusion 102.2 is illustrated as cylindrical but may have any appropriate shape including, for example, a polygonal (e.g., square, rectangular, hexagonal, etc.) cross section.

The interface between the latches 105, 106 and the plunger 102 is illustrated with a male protrusion (plunger interface portion 105.2, 106.2) extending from each latch 105, 106 into a female portion (latch interface portion 102.5, 102.6) of the plunger 102 where these interfaces include curved "lollipop" shapes that slide relative to one another. However, it should be understood that the arrangement may be reversed such that one or both of the latches 105, 106 include a female recess that interfaces with a male protrusion extending from the plunger 102. In addition, the shape for the interfacing surfaces of these components may be other appropriate shapes or configuration including more angular or flat surfaces, gear driven, or any other appropriate interface.

To operate the charging handle assembly 100, the operator may engage one or both of interface surfaces 103.5 of the handles 103, 104. The operator's engagement of interface surfaces 103.5 causes the handles 103, 104 to pivot about holes 103.1 (see FIGS. 5A and 5B). Rearward pressure against interface surface 103.5 causes the left handle 103 to rotate counterclockwise about hole 103.1 when viewed from above (e.g., see FIGS. 1 and 3). This rotation of left handle 103 causes contact surface 103.6 to press against bearing surface 105.4 of the left latch 105. The left latch 105 may be located within the deep recess 103.4 below the tongue 103.7 of the left handle 103 (i.e., in the orientation shown in FIG. 5A). Due to the force applied by left handle 103, the left latch 105 rotates about hole 105.1 in the same direction (counterclockwise when viewed from above). This rotation of left latch 105 causes the receiver interface member 105.3 to rotate and consequently move away from the upper receiver which disengages the charging handle assembly 100 from the upper receiver (i.e., the charging handle assembly 100 is free to move relative to the upper receiver). In some embodiments, the rotation of left latch 105 also causes the plunger interface portion 105.2 to push against left latch interface portion 102.5 of the plunger 102 such that the plunger 102 moves relative to the main body 101. Due to the configuration of the cavity 101.2 and the protrusion 102.2, the rotation of left latch 105 causes the plunger 102 to move forward. Rotation of one or both of the latches 105, 106 may cause the plunger 102 to move in a rectilinear manner. In some cases, forward movement of the plunger 102 compresses a spring 123 arranged within the cavity 101.2. For example, when viewed from above, counterclockwise rotation of the left latch 105 (and/or clockwise rotation of secondary latch 106) causes the plunger 102 to move forward in a straight line compressing spring 123. Similarly, when viewed from above, clockwise rotation of the left latch 105 (and/or counterclockwise rotation of secondary latch 106) causes the plunger 102 to move rearward in a straight line allowing spring 123 to extend. The spring 123 may create resistance for both left handle 103 and right handle 104. The protrusion 102.2 may be inserted into the spring 123 (and/or may be coaxial with the spring 123). In other embodiments, the spring 123 is smaller in diameter than the protrusion 102.2 such that the end of the protrusion 102.2 interfaces with the spring 123. Forward movement of the plunger 102 also causes right latch interface portion 102.6 to push against the plunger interface portion 106.2 of secondary latch 106. Accordingly, due to the pressure from the plunger 102, the secondary latch 106 rotates clockwise about hole 106.1 when viewed from above. The rotation of the secondary latch 106 caused by the plunger 102 may cause the secondary latch 106 to press against the right handle 104 and cause a corresponding rotation of right handle 104 about hole 103.1 (clockwise when viewed from above). The charging handle assembly 100 may include a spacer between the right handle 104 and the secondary latch 106. The spacer may include at least one of a compliant member (e.g., a spring) and/or a solid member. The compliant member or spring may be a leaf spring, a coil spring, a disc spring, a Belleville spring, a conical spring, a helical spring, and/or any other appropriate component. In some embodiments, rotation of secondary latch 106 presses against detent pin 110 (at detent interface surface 106.5), which compresses spring 122 (i.e., a coil spring) thus causing rotation of right handle 104 about hole 103.1 (clockwise when viewed from above). Accordingly, the operator may engage the interface surface 103.5 of the left handle 103 (without engaging right handle 104) and the charging handle assembly 100 can be disengaged from the upper receiver and the right handle 104 will pivot based on this engagement.

Operation of the charging handle assembly 100 can also occur based on interaction with the right handle 104. Rearward pressure against interface surface 103.5 causes the right handle 104 to rotate clockwise about hole 103.1 when viewed from above (e.g., see FIGS. 1 and 3). This rotation of right handle 104 causes contact surface 103.6 to press against bearing surface 106.4 of the secondary latch 106. The secondary latch 106 may be located within the deep recess 103.4 above the tongue 103.7 of the right handle 104 (i.e., in the orientation shown in FIG. 5B). Due to the force applied by right handle 104, the secondary latch 106 rotates about hole 106.1 in the same direction (clockwise when viewed from above). This rotation of secondary latch 106 causes the plunger interface portion 106.2 to push against right latch interface portion 102.6 of the plunger 102 such that the plunger 102 moves relative to the main body 101. Due to the configuration of the cavity 101.2 and the protrusion 102.2, the rotation of secondary latch 106 causes the plunger 102 to move forward. In some cases, forward movement of the plunger 102 compresses a spring 123 arranged within the cavity 101.2. The protrusion 102.2 may be inserted into the spring 123 (and/or may be coaxial with the spring 123). In other embodiments, the spring 123 is smaller in diameter than the protrusion 102.2 such that the end of the protrusion 102.2 interfaces with the spring 123. Forward movement of the plunger 102 also causes left latch interface portion 102.5 to push against the plunger interface portion 105.2 of left latch 105. Accordingly, due to the pressure from the plunger 102, the left latch 105 rotates counterclockwise about hole 105.1 when viewed from above. The rotation of the left latch 105 caused by the plunger 102 causes the receiver interface member 105.3 to rotate and consequently move away from the upper receiver which disengages the charging handle assembly 100 from the upper receiver (i.e., the charging handle assembly 100 is free to move relative to the upper receiver). The rotation of left latch 105 may also cause a corresponding rotation of left handle 103 about hole 103.1 (counterclockwise when viewed from above). The charging handle assembly 100 may include a spacer between the left handle 103 and the left latch 105. The spacer may include at least one of a compliant member (e.g., a spring) and/or a solid member. The compliant member or spring may be a leaf spring, a coil spring, a disc spring, a Belleville spring, a conical spring, a helical spring, and/or any other appropriate component. In some embodiments, rotation of left latch 105 presses against detent pin 109 (at detent interface surface 105.5), which compresses spring 121 (i.e., a coil spring) thus causing rotation of left handle 103 about hole 103.1 (counterclockwise when viewed from above). Accordingly, the operator may engage the interface surface 103.5 of the right handle 104 (without engaging left handle 103) and the charging handle assembly 100 can be disengaged from the upper receiver and the left handle 103 will pivot based on this engagement.

The foregoing is based on the operator only pressing one of the two interface surfaces 103.5 of the left handle 103 or the right handle 104, without engaging the opposite side. However, it should be understood that the operator can engage both interface surfaces 103.5 simultaneously (i.e., pulling both left handle 103 and right handle 104) such that the force required to compress spring 123 is distributed between each side. These forces may be distributed equally, while in other cases, due to sequence of engaging the interface surfaces 103.5 or other factors, the forces are distributed unequally between the two sides.

The detent pins 109, 110 and corresponding springs 121, 122, in some embodiments, function to prevent excessive motion for one or both of the handles 103, 104. Due to variation in geometry in commercially available firearm components (e.g., upper receivers and/or other relevant components) and due to manufacturing tolerances, there is a gap between (i) detent interface surface 105.5 of left latch 105 and (ii) surface 103.8 of left handle 103. There is a similar gap between (i) detent interface surface 106.5 of secondary latch 106 and (ii) surface 103.8 of right handle 104. The detent pins 109, 110 and corresponding springs 121, 122 impart slight pressure to push the handle 103, 104 away from the corresponding latch 105, 106.

In some embodiments, including illustrative examples shown in FIGS. 9-14C, a charging handle assembly 1000 includes a handle shaft 1010, an outer retainer 1030, a central retainer 1090, an inner retainer 1050, at least one bearing 1070, and a fastener 1002. The fastener 1002 may secure the components together such that the fastener 1002 passes through hole 1031 of the outer retainer 1030, hole 1091 of the central retainer 1090, and hole 1051 of the inner retainer 1050. In some embodiments, the fastener 1002 includes threads 1002.1 that engage within hole 1011 of the handle shaft 1010 and the head 1002.2 of fastener 1002 may be arranged within a counterbored portion of the hole 1031 of the outer retainer 1030 (see FIGS. 9 and 10). The fastener 1002 is illustrated as a shoulder bolt, but the fastener 1002 may be any appropriate type of fastener. The at least one bearing 1070 is illustrated as a spherical ball bearing. However, it should be understood that the bearing(s) 1070 may be cylindrical or any other appropriate shape.

Figure 11A:
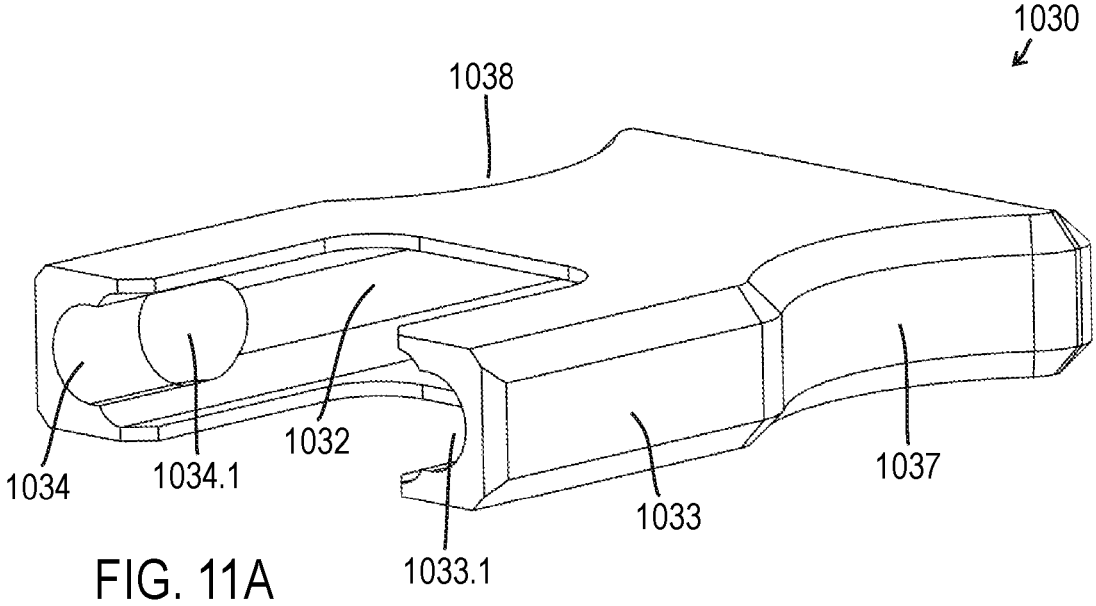
FIG. 11A is a front perspective view of an outer retainer of the charging handle assembly of FIG. 9.
Figure 11B:
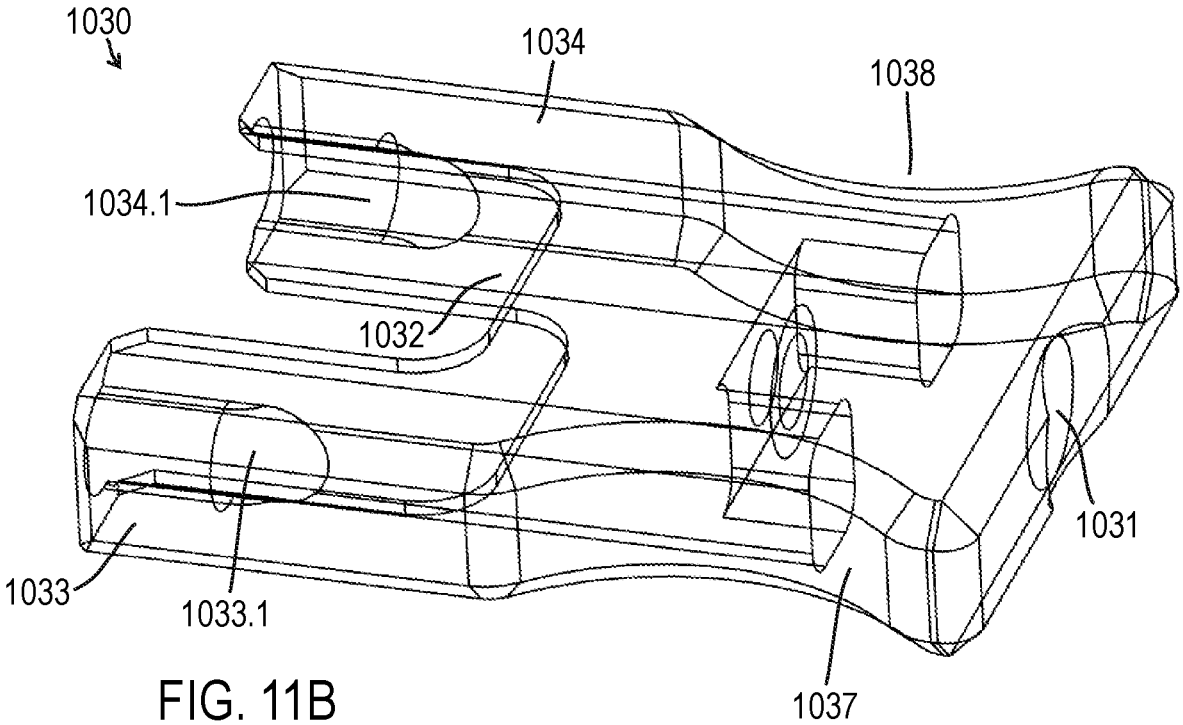
FIG. 11B is a rear perspective transparent view of the outer retainer of FIG. 11A.
Figure 12A:
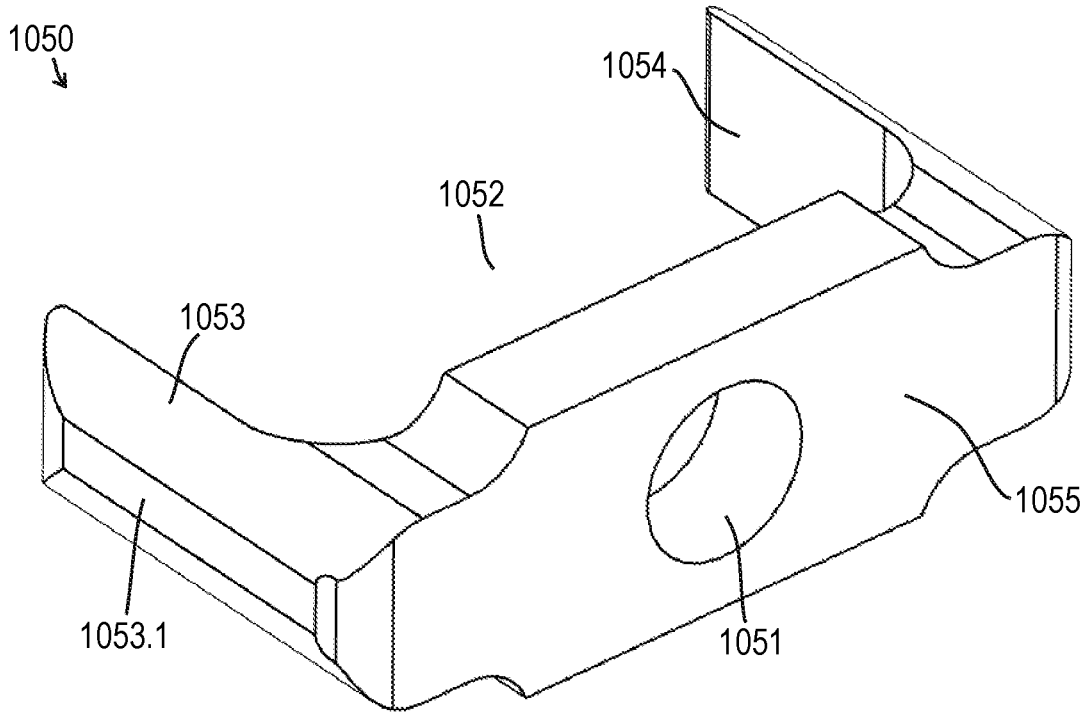
FIG. 12A is a rear perspective view of an inner retainer of the charging handle assembly of FIG. 9.
Figure 12B:
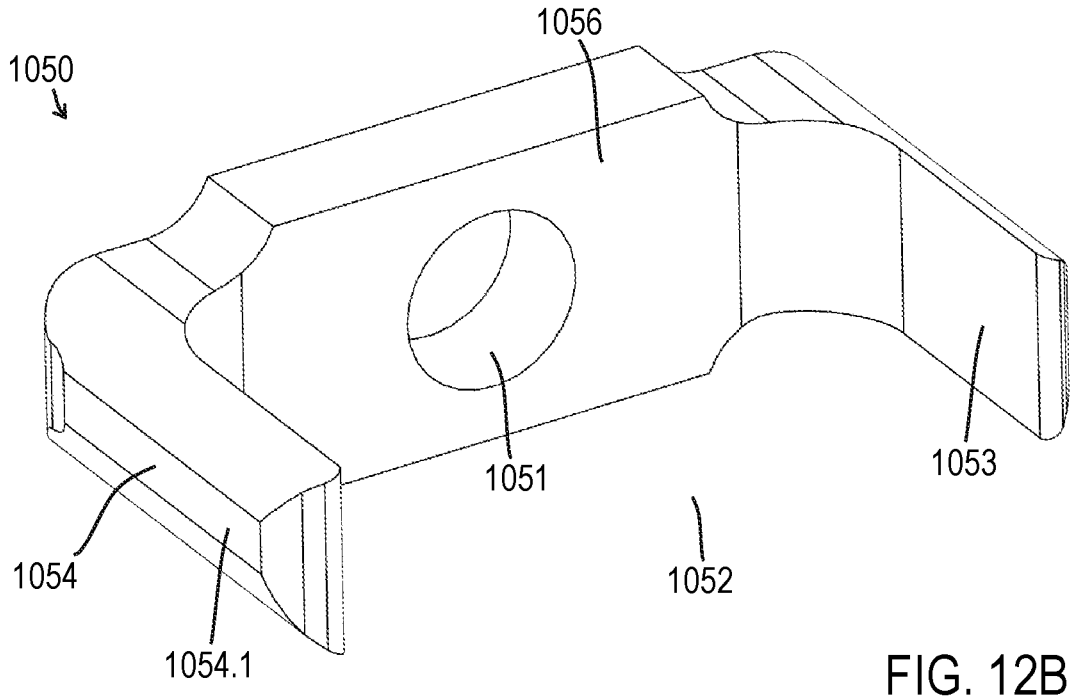
FIG. 12B is a front perspective view of the inner retainer of FIG. 12A.
Figure 13A:
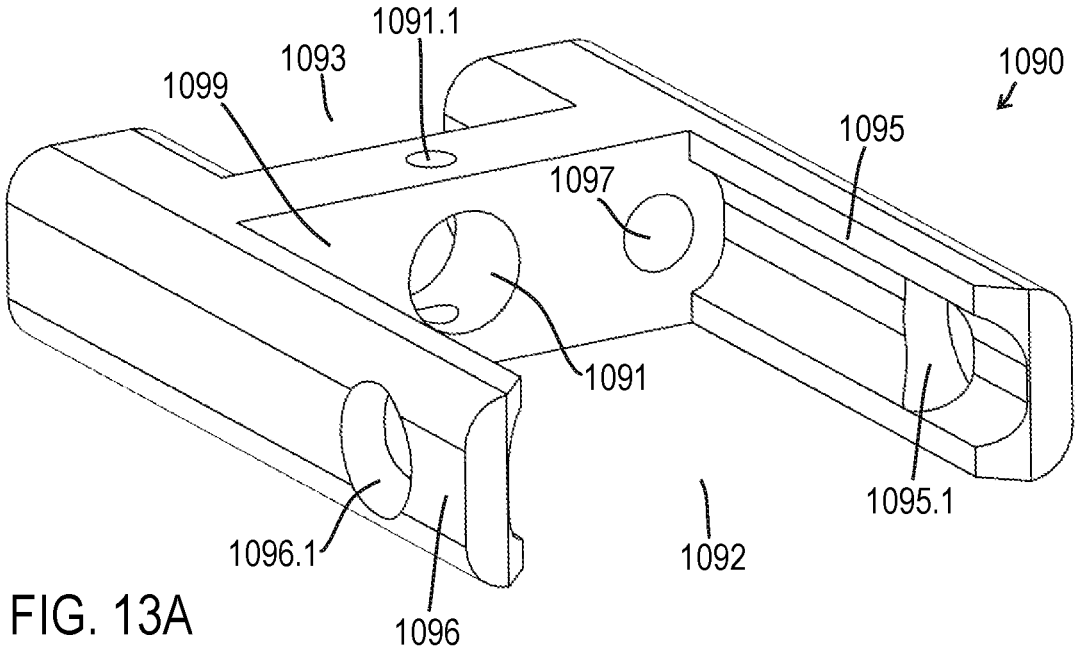
FIG. 13A is a front perspective view of a central retainer of the charging handle assembly of FIG. 9.
Figure 13B:
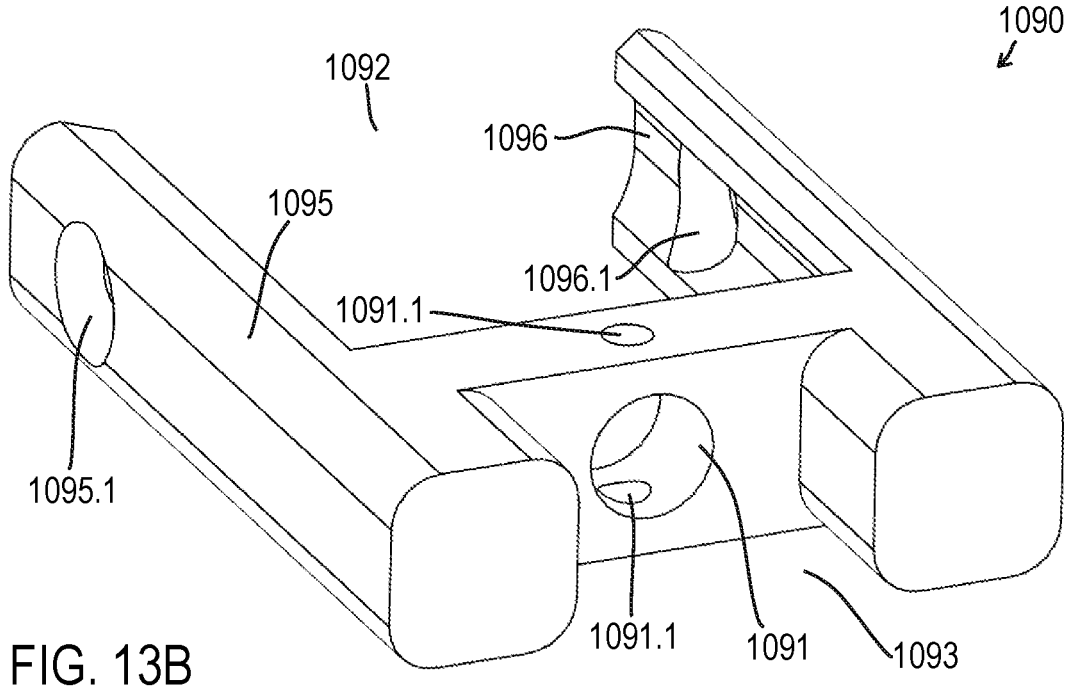
FIG. 13B is a rear perspective transparent view of the central retainer of FIG. 13A.
Figure 14A:
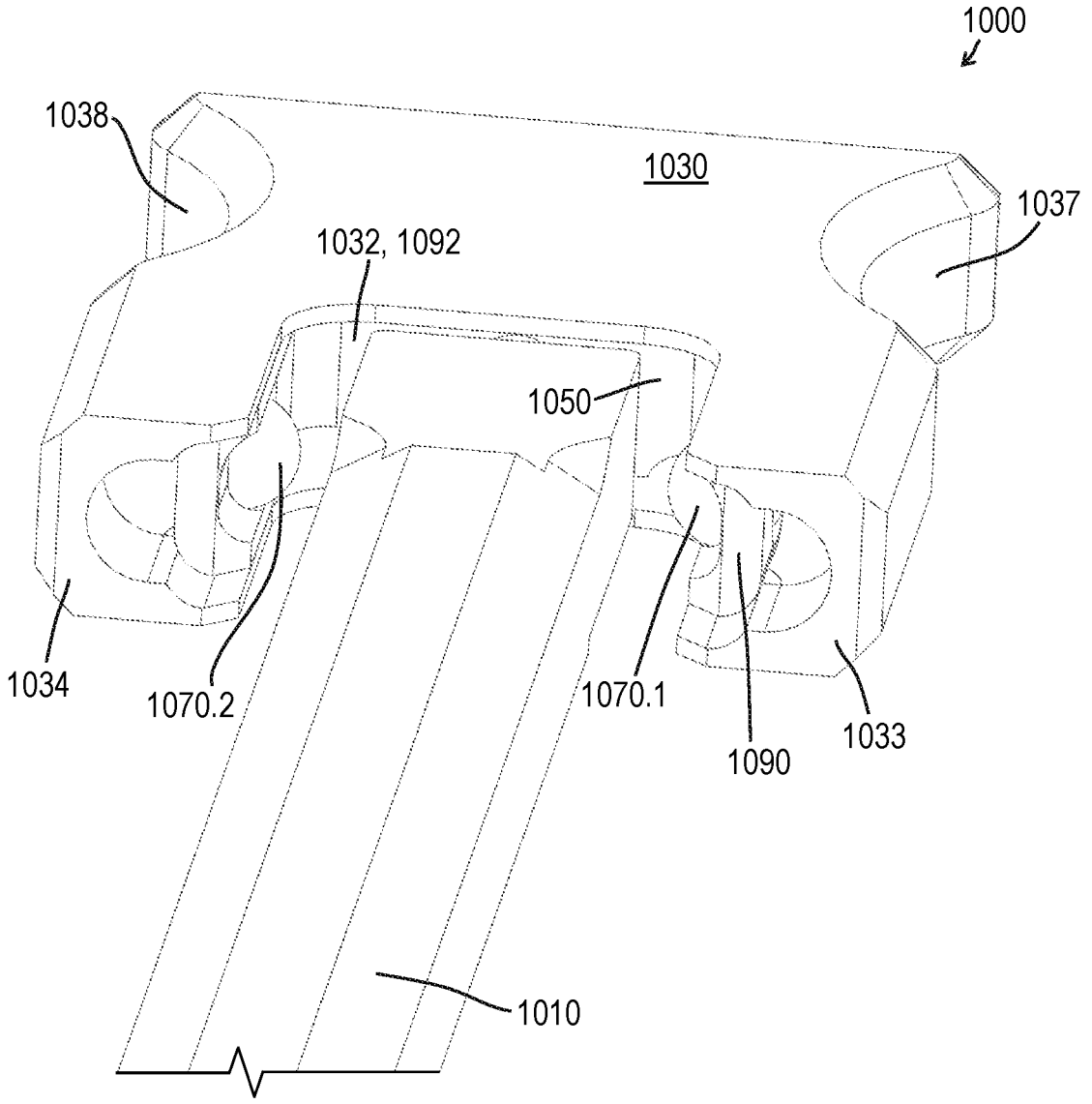
FIG. 14A is a partial front perspective view of the charging handle assembly of FIG. 9 in a first configuration.
Figure 14B:
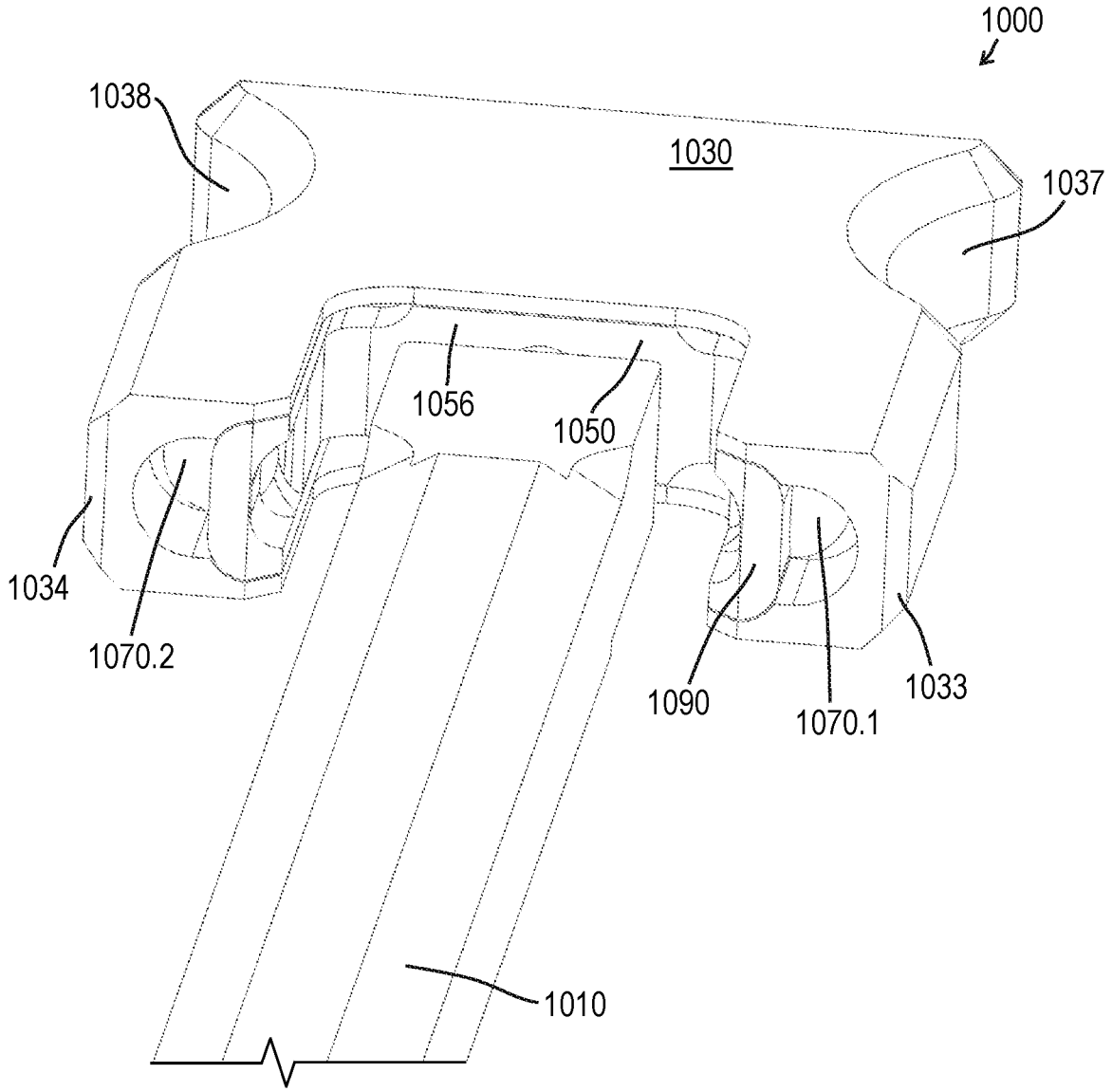
FIG. 14B is a partial front perspective view of the charging handle assembly of FIG. 9 in a second configuration.
Figure 14C:
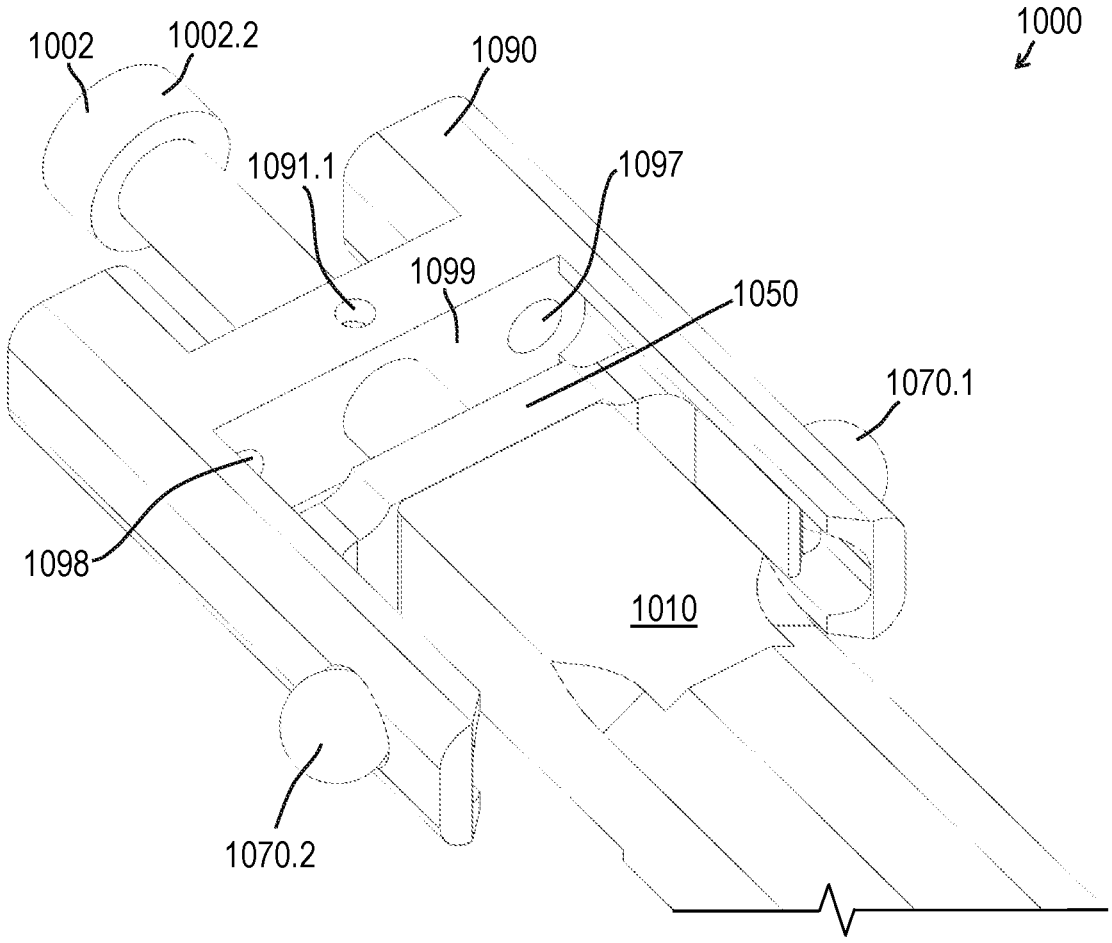
FIG. 14C is a partial front perspective view of the charging handle assembly of FIG. 9 in a third configuration.

The outer retainer 1030 may include a cavity 1032 that is at least partially located between the left arm 1033 and the right arm 1034 (see FIGS. 11A-11B). As shown in FIGS. 14A and 14B, the cavity 1032 may include surfaces that approximately correspond to the outer shape of the central retainer 1090 such that the central retainer 1090 fits inside the cavity 1032. In some cases, the cavity 1032 includes concave portions of the left arm 1033 and the right arm 1034, including the inner contours 1033.1, 1034.1. The central retainer 1090 may include a forward cavity 1092 and a rear cavity 1093 that are each at least partially located between the left arm 1095 and the right arm 1096 (see FIGS. 13A-13B). As shown in FIGS. 14A-14C, the forward cavity 1092 may include surfaces that approximately correspond to the outer shape of the inner retainer 1050 such that the inner retainer 1050 fits inside the forward cavity 1092. In some cases, the forward cavity 1092 includes concave portions of the left arm 1095 and the right arm 1096. In some embodiments, the rear cavity 1093 engages internal features of the outer retainer 1030 (see FIG. 11B). The inner retainer 1050 may include a cavity 1052 that is at least partially located between the left arm 1053 and the right arm 1054 (see FIGS. 12A-12B). In some cases, a portion of the handle shaft 1010 is located within the cavity 1052.

Movement of the components of the charging handle assembly 1000 may be based on the shaft 1002.3 of the fastener 1002 and at least one internal spring. The spring(s) are not illustrated for simplicity. In some embodiments, the fastener 1002 includes a hole 1002.4 through the shaft 1002.3 such that the central retainer 1090 can be pinned (through hole 1091.1) in position relative to the fastener 1002 (see FIGS. 13A-13B, 14C). Based on this configuration, the fastener 1002, the central retainer 1090, and the handle shaft 1010 are static components while the remaining components (the outer retainer 1030, the inner retainer 1050, and the at least one bearing 1070) are dynamic based on operator input. In this context, the entire charging handle assembly 1000 is moved by the operator and the buffer spring of the firearm (not shown) such that static components see no other motion while the dynamic components move relative to the static components.

The charging handle assembly 1000 may include a spring within the counterbored portion of hole 1031 of the outer retainer 1030 such that the spring is arranged between the head 1002.2 of fastener 1002 and the internal surface of hole 1031. Consequently, there is spring pressure pushing the outer retainer 1030 forward relative to the static components. For example, FIG. 14A shows the charging handle assembly 1000 in an installed configuration where the outer retainer 1030 is in a forward position relative to the central retainer 1090. In this configuration, the inner retainer 1050 is pressed against a rear surface of the upper receiver of the firearm (not shown) and the inner surface(s) of the outer retainer 1030 press the at least one bearing 1070 inward to engage a corresponding cavity of the upper receiver. The rear surface 1055 of the inner retainer 1050 may be pushed in contact with or near surface 1099 of the central retainer 1090 (depending on the spring configuration between the inner retainer 1050 and the central retainer 1090, which is described below). In some embodiments, a left bearing 1070.1 is located in hole 1095.1 of the central retainer 1090 and is pushed inward by the inner contour 1033.1 of the left arm 1033 of the outer retainer 1030 when pressed forward (see FIG. 14A). Similarly, a right bearing 1070.2 may be located in hole 1096.1 of the central retainer 1090 and may be pushed inward by the inner contour 1034.1 of the right arm 1034 of the outer retainer 1030 when pressed forward (see FIG. 14A). The inner contours 1033.1, 1034.1 illustrate a straight cylindrical portion and a tapered portion where the tapered portion is shown with a curved or spherical taper. However, it should be understood that the inner contours 1033.1, 1034.1 may have a more angular profile (such as a rectangular cross section) and the tapered portions may include planar ramped surfaces or any other appropriate shape (compatible with spherical bearings, cylindrical bearings, or other types of bearings).

To operate the charging handle assembly 1000, an operator may pull the outer retainer 1030 rearward. As shown in FIGS. 11A, 11B, 14A, and 14B, the outer retainer 1030 may include a left grip surface 1037 and a right grip surface 1038 to facilitate an ergonomic interface for the operator. Rearward movement of the outer retainer 1030 compresses the spring located between the head 1002.2 of fastener 1002 and the internal surface of hole 1031 (described above). FIG. 14B illustrates a second configuration that occurs immediately after the operator pulls the outer retainer 1030 and shows the movement of the components relative to the first configuration (FIG. 14A) where the bearing(s) are engaged within corresponding recesses in the upper receiver. In the second configuration (FIG. 14B), the outer retainer 1030 has moved rearward relative to the static components (the fastener 1002, the central retainer 1090, and the handle shaft 1010) and consequently, the tapered portions of the inner contours 1033.1, 1034.1 are no longer pushing the bearings 1070 inward. In the second configuration, the interface with the upper receiver is free to press the bearing(s) 1070 outward toward/into the non-tapered (e.g., straight cylindrical) portion of the inner contours 1033.1, 1034.1. Once the bearing(s) 1070 move outward and disengage from the upper receiver, the charging handle assembly 1000 can be pulled rearward such that the forward protrusion 1015 of the handle shaft 1010 engages and moves a bolt or bolt carrier group of the firearm. The handle shaft 1010 may include at least one forward lateral protrusion 1013, 1014 that engage a corresponding feature (i.e., a slot) in an upper receiver of a firearm (see FIGS. 9 and 10).

As the charging handle assembly 1000 moves rearward away from the upper receiver, the inner retainer 1050 is free to move forward. The third configuration shows the charging handle assembly 1000 after this movement in FIG. 14C. The outer retainer 1030 is not shown in FIG. 14C for clarity. In some embodiments, the charging handle assembly 1000 includes at least one spring between the inner retainer 1050 and the central retainer 1090. A first spring may be located within hole 1097 of the central retainer 1090 and a second spring may be located within hole 1098 of the central retainer 1090 where these springs push the inner retainer 1050 forward when the inner retainer 1050 is not pressed against the upper receiver of the firearm. In some cases, the holes 1097, 1098 are blind holes such that one end of each spring rests in the bottom of the holes 1097, 1098 while the opposite end of each spring presses against rear surface 1055 of the inner retainer 1050. In some cases, when the inner retainer 1050 is moved to a forward position, the forward face 1056 is pressed near or in contact with a rear surface of the handle shaft 1010. As shown in FIG. 14C, in the forward position, the outer surface 1053.1 of the left arm 1053 of the inner retainer 1050 pushes the left bearing 1070.1 outward through hole 1095.1 of the central retainer 1090. Similarly, in the forward position, the outer surface 1054.1 of the right arm 1054 of the inner retainer 1050 pushes the right bearing 1070.2 outward through hole 1096.1 of the central retainer 1090. The primary purpose of the inner retainer 1050 is to prevent the bearing(s) 1070 from falling out of the holes 1097, 1098 when the charging handle assembly 1000 is pulled rearward away from the upper receiver of the firearm. In this configuration, the bearing(s) 1070 are located within the holes 1097, 1098 constrained on the outside by the arms 1033, 1034 of the outer retainer 1030 and constrained on the inside by the arms 1053, 1054 of the inner retainer 1050. In all other configurations (i.e., when the charging handle assembly 1000 moves back forward), the bearing(s) 1070 are located within the holes 1097, 1098 constrained on the outside by the arms 1033, 1034 of the outer retainer 1030 and constrained on the inside by the upper receiver.

The components of any of the charging handle assemblies 100, 1000 described herein may be formed of materials including, but not limited to, thermoplastic, carbon composite, plastic, nylon, polyetherimide, steel, aluminum, stainless steel, tool steel, high strength aluminum alloy, titanium, other plastic or polymer materials, other metallic materials, other composite materials, or other similar materials. Moreover, the components may be attached to one another via suitable fasteners, which include, but are not limited to, screws, bolts, rivets, welds, over molding, injection molding, epoxy, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A charging handle assembly for a firearm comprising:

a main body comprising a head and a shaft extending forward from the head;

a left handle disposed at the head;

a right handle that is a separate part from the left handle, wherein the right handle is disposed at the head; and at least one latch comprising a latch rotation hole, wherein:

the left handle comprises a left handle rotation hole;

the left handle and the at least one latch are separate components from one another;

the latch rotation hole and the left handle rotation hole are coaxial; and the left handle and the right handle are identical.

2. The charging handle assembly of claim 1, further comprising a plunger disposed at the head.

3. The charging handle assembly of claim 2, wherein rotation of the at least one latch causes the plunger to move in a rectilinear manner.

4. The charging handle assembly of claim 2, wherein the plunger comprises a body and a protrusion extending forward from the main body.

5. The charging handle assembly of claim 4, further comprising a spring, wherein at least a portion of the plunger is inserted inside the spring.

6. The charging handle assembly of claim 4, wherein the body of the plunger comprises a rectangular cross section and the protrusion of the plunger comprises a circular cross section.

7. The charging handle assembly of claim 1, wherein:
the at least one latch further comprises a secondary latch with a secondary latch rotation hole;
the right handle comprises a right handle rotation hole;
the right handle and the secondary latch are separate components from one another; and
the secondary latch rotation hole and the right handle rotation hole are coaxial.

8. The charging handle assembly of claim 1, further comprising a left fastener extending through the head of the main body, the left handle, and the at least one latch.

9. The charging handle assembly of claim 1, wherein the left fastener comprises threads that engage a lower portion of the head of the main body.

10. The charging handle assembly of claim 1, wherein the shaft comprises a forward protrusion extending downward from the shaft.

11. The charging handle assembly of claim 1, further comprising a spacer between (i) the at least one latch and (ii) at least one selected from the group of the left handle and the right handle.

12. The charging handle assembly of claim 11, wherein the spacer comprises a spring.

13. The charging handle assembly of claim 1, wherein at least one selected from the group of the left handle and the right handle extends in a lateral direction beyond the head.

14. A charging handle assembly for a firearm comprising:
a main body comprising a head and a shaft extending forward from the head;
a left handle disposed at the head;
a right handle disposed at the head;
a primary latch disposed at the head; and
a secondary latch disposed at the head, wherein:
the right handle comprises a right handle rotation hole;
at least one of the left handle and the right handle is rotatable relative to the head;
the secondary latch comprises a rotation hole that is coaxial with the right handle rotation hole; and
the primary latch is a separate component from both the left handle and the right handle.

15. The charging handle assembly of claim 14, wherein the left handle and the right handle are identical and are separate from one another.

16. The charging handle assembly of claim 14, further comprising a plunger disposed at the head.

17. The charging handle assembly of claim 16, wherein rotation of the at least one latch causes the plunger to move in a rectilinear manner.

18. The charging handle assembly of claim 16, wherein the plunger comprises a body and a protrusion extending forward from the main body.

19. The charging handle assembly of claim 14, wherein at least one selected from the group of the left handle and the right handle extends in a lateral direction beyond the head.

20. The charging handle assembly of claim 14, wherein:
the primary latch comprises a left latch with a left latch rotation hole;
the left handle comprises a left handle rotation hole; and
left latch rotation hole and the left handle rotation hole are coaxial.

21. A charging handle assembly for a firearm comprising:
a main body comprising a head and a shaft extending forward from the head;
a left handle disposed at the head;
a right handle disposed at the head;
a plunger disposed at the head; and
at least one latch comprising a latch rotation hole, wherein:
the left handle comprises a left handle rotation hole;
the left handle and the at least one latch are separate components from one another;
the latch rotation hole and the left handle rotation hole are coaxial;
the left handle and the right handle are identical; and
the plunger comprises a body and a protrusion extending forward from the main body.

22. A charging handle assembly for a firearm comprising:
a main body comprising a head and a shaft extending forward from the head;
a left handle disposed at the head;
a right handle disposed at the head;
at least one latch comprising a latch rotation hole; and
a left fastener extending through the head of the main body, the left handle, and the at least one latch, wherein:
the left handle comprises a left handle rotation hole;
the left handle and the at least one latch are separate components from one another;
the latch rotation hole and the left handle rotation hole are coaxial; and
the left handle and the right handle are identical.

* * * * *